United States Patent [19]

Nozaki

[11] Patent Number: 4,934,115

[45] Date of Patent: Jun. 19, 1990

[54] HINGED WALL CONSTRUCTION

[75] Inventor: Yuichi Nozaki, Kurobe, Japan

[73] Assignee: Yoshida Kogyo, K.K., Tokyo, Japan

[21] Appl. No.: 281,283

[22] Filed: Dec. 8, 1988

[30] Foreign Application Priority Data

May 23, 1988 [JP] Japan ..... 63-67812[U]

[51] Int. Cl.[5] ..... E04B 1/344

[52] U.S. Cl. ..... 52/71; 52/579; 52/588; 52/593; 52/595; 160/235

[58] Field of Search ..... 160/135, 235; 52/71, 52/65, 64, 277, 399, 201, 579, 588, 593, 595; 16/356

[56] References Cited

U.S. PATENT DOCUMENTS

| | | | |
|---|---|---|---|
| 2,641,018 | 6/1953 | Snyder | 160/235 |
| 4,663,896 | 5/1987 | Dunnick | 52/71 |

FOREIGN PATENT DOCUMENTS

| | | | |
|---|---|---|---|
| 2634266 | 2/1978 | Fed. Rep. of Germany | 52/71 |
| 56-19612 | 2/1981 | Japan . | |
| 111986 | 11/1967 | Norway | 160/235 |
| 862027 | 3/1961 | United Kingdom | 16/356 |
| 2016574 | 9/1979 | United Kingdom | 52/71 |
| 2105396 | 3/1983 | United Kingdom | 160/235 |

*Primary Examiner*—Michael Safavi

*Attorney, Agent, or Firm*—Hill, Van Santen, Steadman & Simpson

[57] ABSTRACT

A unit building wall construction includes at least two wall units and a joint structure for the two wall unit comprising a set of pairs of sealingly and slidably interengaging interior and exterior flanges of two adjacent frame members of the unit walls, and a hinge disposed between the interior and exterior flanges and pivotally interconnecting the frame members.

12 Claims, 5 Drawing Sheets

HINGED WALL CONSTRUCTION

BACKGROUND OF THE INVENTION

1. Field of the Invention:

The present invention relates generally to a unit wall composed of a plurality of wall units arranged in horizontal or vertical juxtaposition and relatively movable to form a curved wall of a building, and more particularly to a joint structure for an adjacent pair of wall units of such unit wall.

2. Description of the Prior Art:

A unit wall including a plurality wall units of a construction suitable for the formation of a curved wall of a building is disclosed, for example, in Japanese Utility Model Laid-open Publication No. 56-19612. The disclosed unit wall, as reillustrated here in FIGS. 9 and 10 of the accompanying drawings, includes two horizontally adjacent wall units each including a vertical frame member A, A' of a generally C-shaped cross section. The C-shaped frame member A, A' has a central web portion B, B' and interior and exterior flanges C, D or C' D' extending perpendicularly outwardly from opposite edges of the web portion B, B' into overlapping engagement with the interior and exterior flanges C', D' or C, D, respectively, of the opposite frame member A', A with interior and exterior seal strips E, F sealingly disposed respectively between the overlapping interior flanges C, C' and between the overlapping exterior flanges D, D'. The web portion B, B' has a longitudinal groove G, G' receiving therein an edge of a panel member H, H' mounted in an opening in each wall unit.

The wall units are horizontally pivotally movable about the interior seal strip E between a coplanar position shown in FIG. 9 and an angled position shown in FIG. 10 so as to form a part of a curved wall. With this construction, the distance between the center 0 of a space defined between the adjacent grooves G, G' and the bottom of each groove G, G' varies with an angle defined between the two wall units, as indicated by I, I' in FIGS. 9 and 10. With this varying distance, tedious and time-consuming measurement and calculation are necessary to install the wall units for forming a curved unit wall.

Furthermore, since the two adjacent wall units are supported together only by two engagement portions each formed by the two overlapping flanges C, C' or D, D', the frame members A, A' are likely to be twisted or deformed when subjected to severe forces or stresses created as in a typhoon or an earthquake. To withstand such severe forces, the frame members A, A' must be thickened which would result in a high manufacturing cost of the frame member.

A further drawback is that the exterior seal strip F is likely to be damaged or broken due to frictional engagement with the external flange D' when the frame members A, A' are tilted abut the interior seal strip E to spread at their exterior sides. With this damaged exterior seal strip E, rainwater and dust are permitted to enter the interior space J between the frame members A, A' and gradually deteriorate the interior seal strip E which would result in an eventual destruction of the weatherproof characteristics of the unit wall.

SUMMARY OF THE INVENTION

It is accordingly an object of the present invention to provide a unit wall having a joint structure which is capable of joining two adjacent wall units easily and accurately into a desired angled position without the necessity of tedious and time-consuming measurement and calculation.

Another object of the present invention is to provide a unit wall having a joint structure for an adjacent pair of wall units of the unit wall, which joint structure is strong enough to withstand severe forces or stresses and provides a hermetic seal between the two adjacent wall unit throughout the lifetime of the unit wall.

According to the present invention, there is provided a unit building wall construction including at least one pair of wall units disposed in juxtaposition and having an adjacent pair of frame members, respectively, and a joint structure for the wall units comprising: a pair of first interior and exterior flanges extending perpendicularly from opposite longitudinal edges of one of the frame members toward the other of the frame members; a pair of second interior and exterior flanges extending perpendicularly from opposite longitudinal edges of the other of the frame members toward the one frame member, the second interior and exterior flanges sealingly and slidably engaging the first interior and exterior flanges, respectively; and a hinge disposed between the interengaging first and second interior flanges and the interengaging first and second exterior flanges and pivotally connecting the two frame members.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE INVENTION

Figure 2:
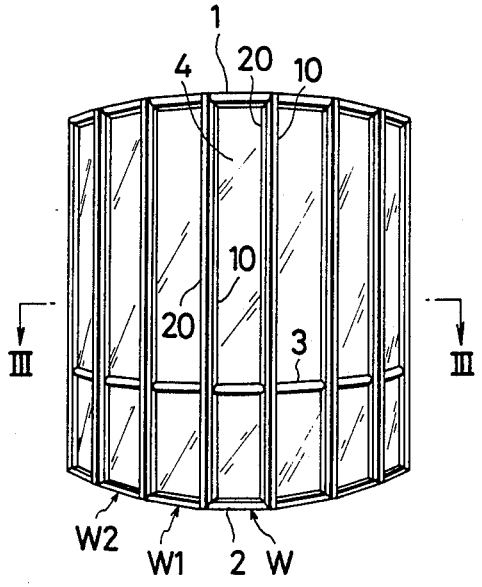
FIG. 2 is a diagrammatical front elevational view showing the general construction of the unit wall.
Figure 3:
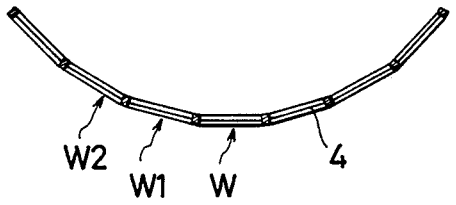
FIG. 3 is an enlarged cross-sectional view taken along line III—III of FIG. 2.

As shown in FIG. 2, a unit wall embodying the present invention includes a plurality of wall units W, W1, W2 (only three being designated) arranged in horizontal juxtaposition to form a curved wall of a building.

Each of the wall units W, W1, W2 has a pair of upper and lower horizontal members 1, 2 and a pair of lateral vertical members 10, 20 extending between and interconnecting the horizontal members 1, 2 to provide a rectangular frame. An intermediate horizontal member 3 extends parallel to the upper and lower horizontal members 1, 2 between the vertical members 10, 20 so as to define with the members 1, 2, 10, 20 upper and lower rectangular openings into which panel members 4 are mounted. The panel members 4 include panes of glass, thermally insulating composite panels, etc.

Figure 1:
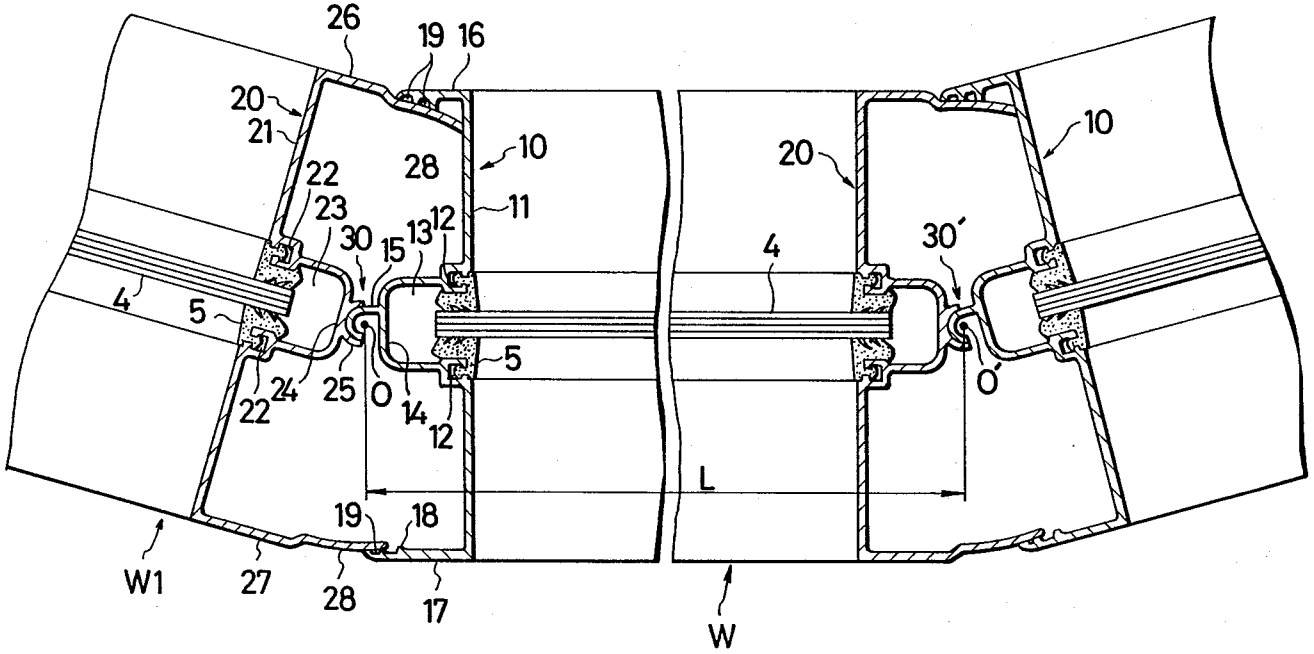
FIG. 1 is a horizontal cross-sectional view of a main part of a unit wall according to the present invention.

As showin in FIG. 1, the vertical frame member 10 of each wall unit W, W1, W2 has a generally C-shaped cross section and includes a central web portion 11 constituting a major part of the vertical frame member 10, and interior and exterior flanges 15, 16 projecting perpendicularly from opposite longitudinal edges of the web portion 11 toward the vertical frame member 20 of the adjacent wall unit W1. The web portion 11 has a pair of parallel spaced longitudinal grooves 12, 12 and a central longitudinal recess 13 disposed between the grooves 12, 12. A pair of elongate gaskets 5 is fitted respectively in the grooves 12, 12 to hold a vertical edge of the panel member 4 which is received in the recess 13. The vertical frame member 10 further has a first pivot member 15 integral with and projecting outwardly from a bottom wall 14 of the recess 13. The first pivot member 15 comprises a hook-shaped plug of a semi-circular cross section. Each of the interior and exterior flanges 16, 17 has on its inner side surface a plurality of longitudinal guide ridges (three in the illustrated embodiment) 18 defining therebetween grooves or troughs 19 for being filled with a sealing material.

The vertical frame member 20 also has a generally C-shaped cross section and includes a central web portion 21 coextensive to the web portion 11, and interior and exterior flanges 26, 27 extending perpendicularly from opposite longitudinal edges of the web portion 21 toward the vertical frame member 10 of the adjacent wall unit W. The web portion 21 has a pair of parallel spaced longitudinal grooves 22, 22 and a central longitudinal recess 23 disposed between the grooves 22, 22 for supporting therein a vertical edge of the panel member 4 by and between a pair of gaskets 5 fitted in the grooves 22, 22. The vertical frame member 20 further has a second pivot member 25 integral with and projecting outwardly from a bottom wall 24 of the recess 23. The second pivot member 25 comprises an arcuate socket of a semi-circular cross section and pivotally receives therein the hook-shaped plug or first pivot member 15 on the vertical frame member 10. The thus coupled first and second pivot members 15, 25 jointly constitutes a hinge 30 which enables the two adjacent wall units W, W1 to pivot horizontally about the central axis 0 of the hinge 30. The interior and exterior flanges 26, 27 have respective arcuate free end portions 28, 28 extending concentrically to the central axis 0 of the hinge. The ridges 18 on each of the flanges 16, 17 of the vertical frame member 10 have respective arcuate upper surfaces complementary in contour to the arcuate end portion 28 of the corresponding flange 26, 27, so that the arcuate end portions 28, 28 of the flanges 26, 27 are guidingly slidable on and along the arcuate upper surfaces of the respective guide ridges 18 on the flanges 16, 17 when the two adjacent wall units W, W1 are tilted to one another.

The hinge 30 composed of the first and second pivot members 15, 25 and the two pairs of overlapping flanges 16, 27 and 17, 27 jointly constituting a joint structure for horizontally pivotally joining an adjacent pair of wall units W, W1, W2 of the unit wall. The vertical frame members 10, 20 are each formed of a profile or section of extruded aluminum.

The wall units W, W1, W2 of the foregoing construction are installed in the manner as described below.

The wall unit W is secured by a non-illustrated fastener to a framework of a building. After the grooves 19 in the interior and exterior flanges 16, 17 are filled with a curable liquid sealant, the next adjacent wall unit W1 is supportd in side by side relation to the wall unit W1. In this instance, the vertical frame member 20 of the wall unit W1 is disposed horizontally adjacent to the vertical frame member 10 of the wall unit W with the arcuate end portions 28 of the flanges 26, 27 guidingly received between the distal edges of the floanges 16, 17 of the vertical frame member 10. Then the wall unit W1 is forced rightwardly in FIG. 1 until the socket-shaped second pivot member 24 guidingly receives therein the plug-shaped first pivot member 15 of the vertical frame member 10 to thereby hinge the two wall units W, W1. The wall unit W1 is turned interiorly about the central axis 0 of the hinge 30 into a desired angular position relative to the wall unit W. In this desired angular position, the wall unit W1 is secured by a non-illustrated fastener to the building framework. The foregoing steps of installation are repeated until a unit curtain wall of a desired curvature is formed by the horizontally joined wall units W, W1, W2.

Figure 4:
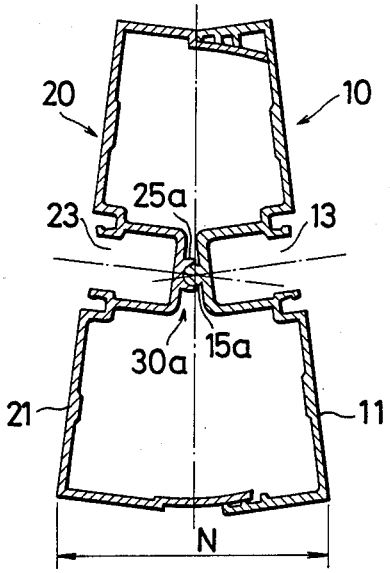
FIGS. 4 through 8 are views similar to FIG. 1, but each showing a modified joint structure according to the present invention.

A modified joint structure shown in FIG. 4 is similar to the joint.structure shown in FIG. 1 but differs therefrom in that the first pivot member of a hinge **30*a* comprises a solid plug of generally circular cross section pivotally received in an arcuate socket-shaped second pivot member 25*a*. The circular cylindrical plug 15*a*** hs a small diameter so that the joint structure has a relatively small width N.

Figure 5:
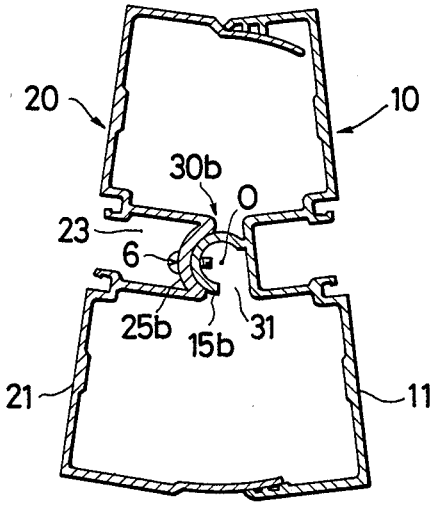

FIG. 5 shows another modified joint structure according to the present invention. This joint structure is substantially the same as the joint structure shown in FIG. 1 with the exception that the first pivot member **15*b* of a hinge 30*b* comprises an arcuate plug of a semi-circular cross section having a relatively large diameter and defining therein a relatively large space 31, while the second pivot member 25*b* is composed of an arcuate recess formed by an inwardly projected arcuate bottom wall of the recess 23. The first and second pivot members 15*b*, 25*b* are firmely connected together by a plurality of fasteners (only one shown) 6. Partly because of the enlarged hinge 30*b* and partly because of the firm connection between the first and second pivot members 15*b*, 25*b*, the joint structure is structurally rigid and strong enough to withstand severe forces which would otherwise tend to twist the vertical frame members 10, 20**.

Figure 6:
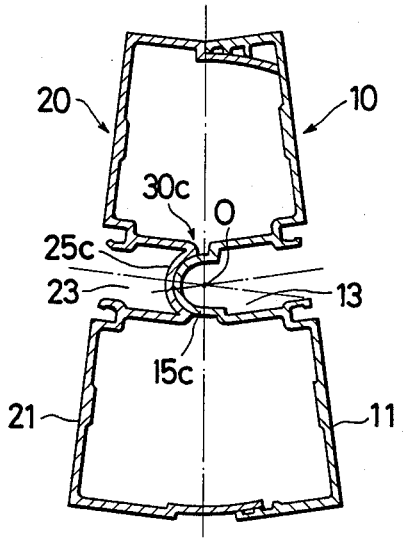

Still another modified joint structure shown in FIG. 6 differs from the joint structure shown in FIG. 5 in that the first pivot member **15*c* of a hinge 30*c* comprises an arcuate plug formed by the outwardly swelled bottom wall of the recess 13 in the vertical frame member 10. The arcuate plug 15*c* is pivotably received in a complementary arcuate socket member 25*c* formed by the inwardly bent arcuate bottom wall of the recess 23 in the vertical frame member 20. With this deformation of the bottom walls, the recesses 13, 23** have different depths.

Figure 7:
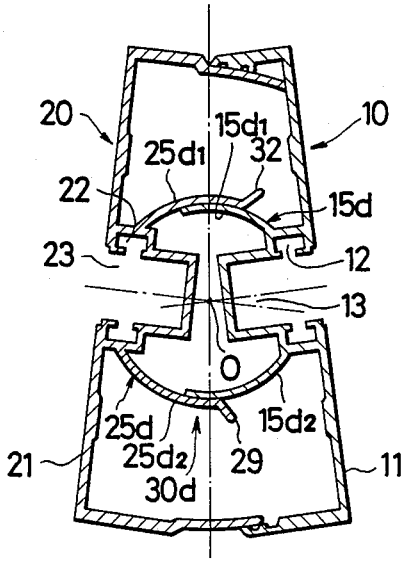

FIG. 7 shows a still further modified from of the joint structure of the present invention. The joint structure includes a hinge **30*d* composed of a pair of first and second pivot members 15*d*, 25*d*. The first pivot member 15*d* includes a pair of arcuate resilient fins $15d_1$, $15d_2$ extending arcuately outwardly from the bottom walls, respectively, of a pair of grooves 12 disposed on opposite sides of the central longitudinal recess 13 of the vertical frame member 10. The arcuate fins $15d_1$, $15d_2$ have the same radius of curvature and define a part of a circle extending about the central axis O of the hinge 30***d*. Likewise, the second pivot member 25*d* includes a pair of arcuate resilient fins 25*d*$_1$, 25*d*$_2$ extending arcuately outwardly from the bottom walls, respectively, of a pair of grooves 22 disposed on opposite sides of the central recess 23 in the vertical frame member 20. The arcuate fins 25*d*$_1$, 25*d*$_2$ have the same radius of curvature and define a part of a circle extending about the central axis 0 of the hinge 30*d*, the diameter of this circle being substantially the same as or slightly larger than the diameter of the circle partly defined by the arcuate fins 15*d*$_1$, 15*d*$_2$ so that the first pivot member 15d is press-fitted in the second pivot member 25*d* when two adjacent unit walls are joined together. The arcuate fins 25*d*$_1$, 25*d*$_2$ each have an outwardly flared guide portion 32 at the distal end thereof for facilitating smooth fitting engagement between the first and second pivot members 15*d*$_1$, 15*d*$_2$. To assemble the joint structure, two horizontally adjacent vertical frame members 10, 20 are disposed in confrontation with the arcuate fins 15*d*$_1$, 15*d*$_2$ abutting on the guide portions 32 of the arcuate fins 25*d*$_1$, 25*d*$_2$. Then one of the frame members 10, 20 is forced toward the other of the frame members 10, 20 whereupon the arcuate fins 15*d*$_1$, 15*d*$_2$ and the arcuate fins 25*d*$_1$, 25*d*$_2$ are caused to flex respectively inwardly and outwardly, thereby forcibly fitting the first pivot member 15*d* into the second pivot member 25*d*.

Figure 8:
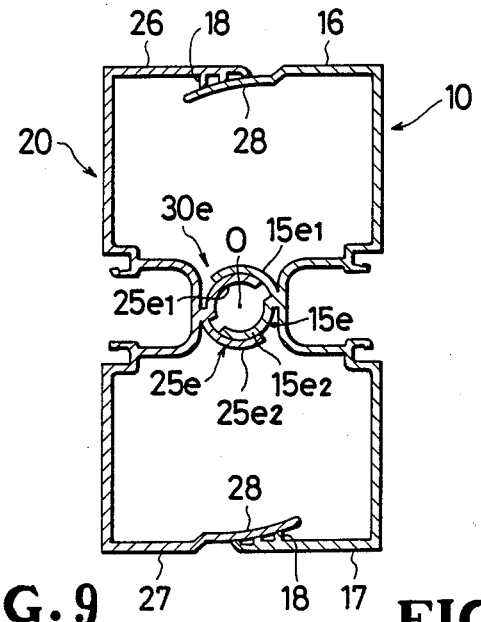
Figure 9:
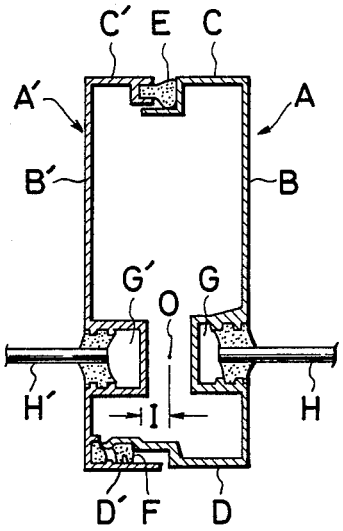
FIG. 9 PRIOR ART
FIG. 9 is a horizontal cross-sectional view of a conventional joint structure for an adjacent pair of wall units as the wall units are disposed in a coplanar position.
Figure 10:
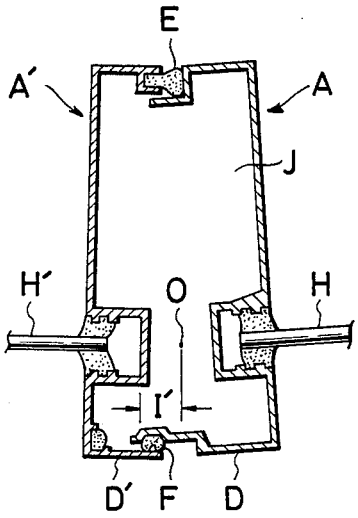
FIG. 10 PRIOR ART
FIG. 10 is a view similar to FIG. 9, showing the conventional joint structure as the wall units are disposed in an angled position.

Another modified joint structure shown in FIG. 8 is similar to the joint structure shown in FIG. 7 but differs therefrom in that first and second pivot members 15*e*, 25*e* of a hinge 30*e* are disposed on the underside of the recesses 13, 23 of two horizontally adjacent vertical frame members 10, 20, each pivot member 15*e*, 25*e* being bifurcated into a pair of arcuate resilient fins 15*e*$_1$, 15*e*$_2$ or 25*e*$_1$, 25*e*$_2$. The first and second pivot members 15*e*, 25*e* are hinged together such that one 15*e*$_1$ of the bifurcated arcuate fins 15*e*$_1$, 15*e*$_2$ is fitted over one 25*e*$_1$ of the bifurcated arcuate fins 25*e*$_1$, 25*e*$_2$ while the other one 15*e*$_2$ of the bifurcated arcuate fins 15*e*$_1$, 15*e*$_2$ is fitted in the other one 25*e*$_2$ of the bifurcated arcuate fins 25*e*$_1$, 25*e*$_2$.

The unit wall having the above-described joint structure has various advantages. The adjacent wall units can be easily assembled together by merely forcing one wall unit edgewise against the other wall unit until the first and second pivot members 15–15*e* and 25–25*e* are coupled together to complete a hinge 30–30*e*. With the thus formed hinge 30–30*e*, the distance L (FIG. 1) between the axis O, O' of pivotal movement of two adjacent unit walls is always constant. Consequently, tedious and time-consuming measurement and calculation are no longer necessary to prepare a design drawing for a curved unit wall and also to install the curved unit wall in accordance with the design drawing. Furthermore, as the two adjacent frame members 10, 20 are interengaged at three points by the two overlapping interior flanges 16, 26, the two overlapping exterior flanges 17, 27 and the hinge 30 disposed between the interior and exterior flanges 16, 26 and 17, 27, the joint structure of such two adjacent frame member is structurally rigid and strong enough to withstand severe forces or stresses. The hinge 30 disposed intermediately between the interior and exterior flanges 16, 26 and 17, 27 serves as a buffle and improves the weatherproof characteristics of the joint structure.

Obviously, various modifications and variations of the present invention are possible in the light of the above teaching. For example, at least one seal strip may be fitted in a longitudinal groove formed in one of interior and exterior flanges 16, 17 or 26, 27 of one of the frame members 10, 20, thereby improving the weatherproofness of the unit wall. The panel-mounting recess 13, 23 may be disposed off center relative to the longitudinal central axis of the web portion 11, 21 of each frame member 10, 20. The joint structure of the unit wall may be used for joining two horizontally adjacent mullion and panel unit of a unit curtain wall as well as two vertically adjacent transom and panel unit of the unit curtain wall. It is therefore to be understood that within the scope of the appended claims the invention may be practiced otherwise than as specifically described.

What is claimed is:

1. A unit building wall construction including at least one pair of wall units disposed in juxtaposition and having an adjacent pair of frame members, respectively, and a joint structure for said wall units comprising:

(a) a first central web portion constituting a major part of one of said frame member, and a pair of first interior and exterior flanges extending perpendicularly from opposite longitudinal edges of said first central web portion toward the other of said frame members;

(b) a second central web portion constituting a major part of said other frame member, and a pair of second interior and exterior flanges extending perpendicularly from opposite longitudinal edges of said second central web portion toward said one frame member, said second interior and exterior flanges slidably engaging said first interior and exterior flanges, respectively; and (c) a hinge disposed between said interengaging first and second interior flanges and said interengaging first and second exterior flanges and pivotally connecting said two frame members, said hinge including a first pivot member disposed on and integral with one of said first and second central web portions, and a second pivot member disposed on and integral with the other of said first and second central web portions and pivotally connected with said first pivot member.

2. A unit building wall construction according to claim 1, each said wall unit including a panel member mounted in an opening in said wall unit and having an edge retained in said frame member of each respective wall unit, said hinge having a central axis about which said two wall units are pivotally movable, said central axis being disposed in a plane in which said panel member lies.

3. A unit building wall construction according to claim 1, said first pivot member comprising a hook-shaped plug of a generally semi-circular cross section, said second pivot member comprising an arcuate socket of a generally semi-circular cross section and pivotally receiving therein said hook-shaped plug.

4. A unit building wall construction according to claim 1, said first pivot member comprising a semicircular cylindrical plug, said second pivot member comprising an annular socket of a generally semi-circular cross section and pivotally receiving therein said semicircular cylindrical plug.

5. A unit building wall construction according to claim 1, said first pivot member comprising an outwardly swelled part of said one frame member, said second pivot member comprising an inwardly swelled part of said other frame member.

6. A unit building wall construction according to claim 1, said first interior and exterior flanges being sealingly engaged with said second interior and exterior flanges, respectively.

7. A unit building wall construction including at least one pair of wall units disposed in juxtaposition and having an adjacent pair of frame members, respectively, and a joint structure for said wall units comprising:

(a) a pair of first interior and exterior flanges extending perpendicularly from opposite longitudinal edges of one of said frame members toward the other of said frame members;

(b) a pair of second interior and exterior flanges extending perpendicularly from opposite longitudinal edges of the other of said frame members toward said one frame member, said second interior and exterior flanges slidably engaging said first interior and exterior flanges, respectively; and (c) a hinge disposed between said interengaging first and second interior flanges and said interengaging first and second exterior flanges and pivotally connecting said two frame members, each said first interior and exterior flanges having, on its inner side surface, at least two guide ridges, said guide ridges having arcuate upper surfaces jointly defining a circle extending around the central axis of said hinge, each said second interior and exterior flanges having an arcuate distal end complementary in contour to the shape of said arcuate upper surfaces of said guide ridges.

8. A unit building wall construction according to claim 7, including a curable liquid sealant filled in a groove defined by and between said guide ridges.

9. A unit building wall construction including at least one pair of wall units disposed in juxtaposition and having an adjacent pair of frame members, respectively, and a joint structure for said wall units comprising:

(a) a pair of first interior and exterior flanges extending perpendicularly from opposite longitudinal edges of one of said frame members toward the other of said frame members;

(b) a pair of second interior and exterior flanges extending perpendicularly from opposite longitudinal edges of the other of said frame members toward said one frame member, said second interior and exterior flanges slidably engaging said first interior and exterior flanges, respectively; and (c) a hinge disposed between said interengaging first and second interior flanges and said interengaging first and second exterior flanges and pivotally connecting said two frame members, said hinge including a first pivot member disposed on and integral with one of said frame members, and a second pivot member disposed on and integral with the other of said frame members and pivotally connected with said first pivot member, said first pivot member comprising a pair of arcuate resilient fins, said second pivot member comprising a pair of arcuate resilient fins press-fitted with said arcuate resilient fins of said first pivot member.

10. A unit building wall construction according to claim 9, said arcuate resilient fins of said first pivot member being fitted in said arcuate resilient fins of said second pivot member.

11. A unit building wall construction according to claim 10, each of said arcuate resilient fins of said second pivot member having an outwardly flared guide portion at the distal end thereof.

12. A unit building wall construction according to claim 9, one of said arcuate resilient fins of said first pivot member being fitted over one of said arcuate resilient fins of said second pivot member, the other of said arcuate resilient fins of said first pivot members being fitted in the other of said arcuate resilient fins of said second pivot member.

* * * * *